US005687585A

United States Patent [19]

Ferrell

[11] Patent Number: 5,687,585

[45] Date of Patent: Nov. 18, 1997

[54] NECKLACE CHAIN SEPARATION DEVICE AND A MULTIPLE STRAND NECKLACE UNIT

[76] Inventor: Kathryn L. Ferrell, HC 66, Box 19, Big Springs, W. Va. 26137

[21] Appl. No.: 599,006

[22] Filed: Feb. 9, 1996

[51] Int. Cl.[6] ..... A44C 15/00

[52] U.S. Cl. ..... 63/21; 24/116 A

[58] Field of Search ..... 63/2, 3, 4, 21, 63/22; 24/616, 116 A, 71 J, 265 WS

[56] References Cited

U.S. PATENT DOCUMENTS

| | | | |
|---|---|---|---|
| 1,578,940 | 3/1926 | Wacha | 24/116 A |
| 2,586,758 | 2/1952 | Zerr | 63/2 |
| 4,530,221 | 7/1985 | Weinberg | 24/116 A |
| 4,611,368 | 9/1986 | Battersby | 24/116 A |
| 4,628,708 | 12/1986 | Ivey | 63/2 |
| 4,754,534 | 7/1988 | Helwick | 63/2 |
| 5,214,940 | 6/1993 | Capifali | 63/2 |
| 5,440,900 | 8/1995 | White | 63/2 |

*Primary Examiner*—Kien T. Nguyen
*Attorney, Agent, or Firm*—Spencer D. Conard

[57] ABSTRACT

A necklace strand separation device and unit is provided for maintaining the separation of multiple chain strands and/or reducing the risk of chain entanglement for a wearer of multiple strands. The device has a shell and spaced apart openings and a pair of engagement members for holding the strands in sequential order and/or a narrow spaced apart openings for preventing the strands from bypassing each other within the openings. The unit has the device and a plurality of chains. The unit and device are useful for reducing the risk of chain entanglement for a wearer of multiple strands of necklaces.

5 Claims, 3 Drawing Sheets

NECKLACE CHAIN SEPARATION DEVICE AND A MULTIPLE STRAND NECKLACE UNIT

BACKGROUND OF THE INVENTION

1. Field of the Invention

The present invention relates to necklace chains and devices used therewith, and more particularly relates to multiple strand necklaces and devices used therewith.

2. Description of the Related Art

Various clasping devices have been developed for necklace chains, see, for example, Wright, U.S. Pat. No. 5,341,659, which is incorporated herein by reference. Such clasping devices are typically designed for clasping opposite loose ends of chains or loose ends of double chains. Wearers of multiple chains, particularly fine (small gauge) gold and silver chains, have experienced the problems of chain entanglement, which not only lacks desirable aesthetic characteristics, but also can make it difficult to remove individual chains from the multiplicity of chains being worn by the person.

Consequently, there is a need for a device which will reduce the likelihood of chain entanglement for multiple chain wearers.

SUMMARY OF THE INVENTION

The present invention involves a necklace separation device (which may serve as a clasp holding device) and a multiple strand necklace unit. The device maintains the separation of portions of a plurality of necklace strands to reduce the likelihood of the strands becoming entangled with each other. The device also enhances the aesthetics by grouping and covering the necklace clasps and keeps them from coming unhooked. The device has (a) a shell having (i) an internal chamber and (ii) spaced apart openings, and preferably (b) a pair of engagement members attached to the shell within the chamber for engaging the portions of the necklace strands. Preferably the openings are sufficiently narrow to maintain the sequential order of the strands. Preferably the shell has a concave upper half, a lower concave half, a hinge connecting the halves in a pivotal fashion, and a pair of spaced apart latch fingers for releasably holding the halves in an engaged position. The device and strands form a multiple strand necklace unit which resists entanglement.

DETAILED DESCRIPTION OF THE INVENTION

Figure 1:
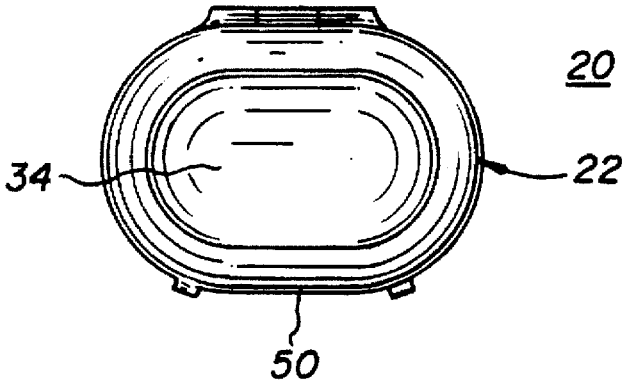
FIG. 1 is a top plan view of a necklace separation device according to the present invention in a closed position.
Figure 2:
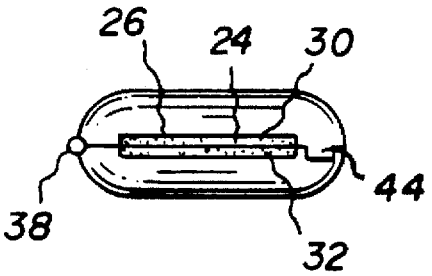
FIG. 2 is a side elevational view of an end of the device of FIG. 1.
Figure 3:
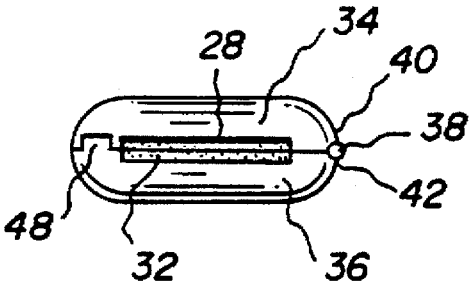
FIG. 3 is a side elevational view of another end of the device of FIG. 2.
Figure 4:
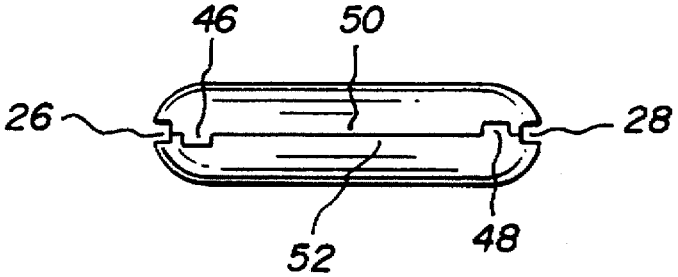
FIG. 4 is a front elevational view of the device of FIG. 1.
Figure 5:
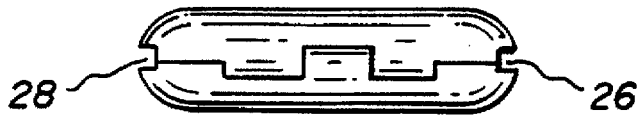
FIG. 5 is a rear elevational view of the device of FIG. 1.
Figure 6:
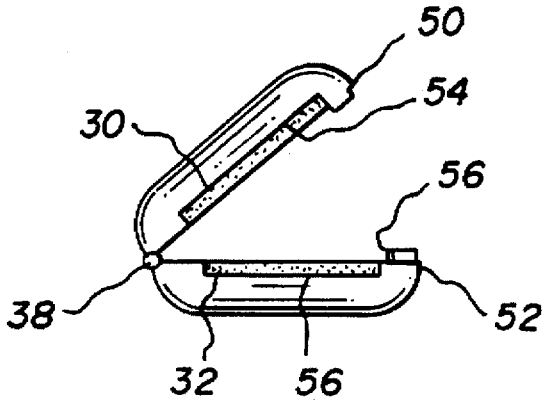
FIG. 6 is a side elevational view of the device of FIG. 1 in an open position.
Figure 7:
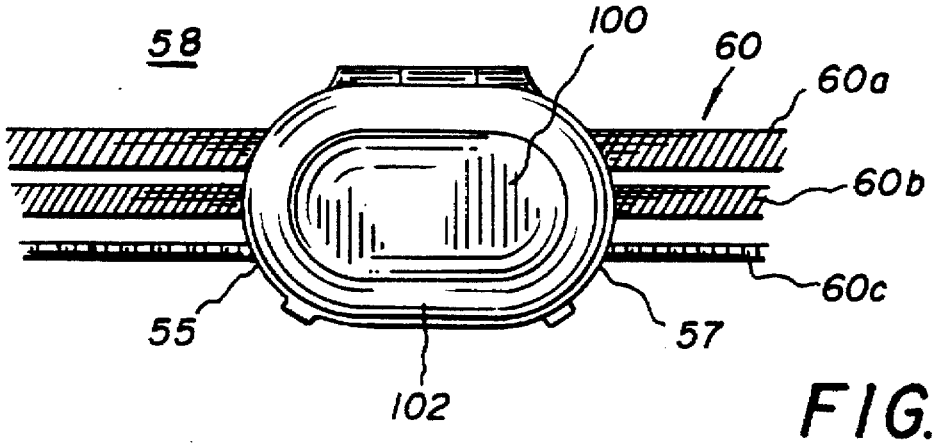
FIG. 7 is a top plan view of a multiple strand necklace unit according to the present invention.
Figure 8:
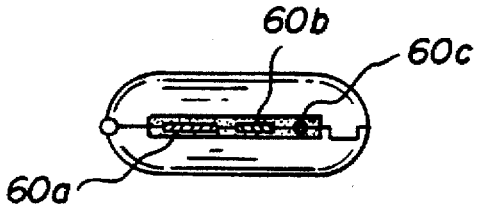
FIG. 8 is a side elevational view of the unit of FIG. 7 with a cross-section of the necklace strands.

As best shown in FIGS. 1, 2, 3, 4, 5 and 6, the necklace strand separation device (20) comprises (a) a shell (22) having (i) an internal chamber (24), (ii) spaced apart openings (26, 28) at opposite ends of the shell (22), and preferably (b) a pair of engagement members (30, 32) attached to opposing concave halves (34, 36) (upper half portion (34), lower half portion (36)) of shell (22) within the chamber (24). A hinge (38) is affixed to the rearward edges (40, 42) of the halves (34, 36 respectively) for hinging (pivotally connecting) the downwardly concave, upper half (34) with the upwardly concave, lower half (36). The device (20) is shown in its closed position in FIGS. 1–5 and 7–9, and in its open position in FIGS. 6 and 11. The chamber (24) is formed by the concave shapes of the upper and lower halves (34, 36) when the device (20) is in its closed position.

The device (20) has a means for biasing (44) the halves (34, 36) in a closed position, and that means for biasing (44) may take the form of an internal spring bias (not shown) or may preferably take the form of a pair of spaced apart fingers (46, 48) attached to either the forward edge of the shell (22) (forward edge (50) of upper half (34), or forward edge (52) of lower half (36)), and preferably extending upward from the forward edge (52) of lower half (36). Optionally one finger may extend upward from the lower half (36) and one downward from the upper half (34), or both fingers may extend downward from the upper half (34). The biasing may be achieved by slight rearward bias of the metal fingers (46, 48) and the upward ends of the fingers (46, 48) snapping over the forwards edge of the halves (36, 38 respectively).

The concave upper half (34) has a circumferential lower most rim (54) which preferably engages a circumferential uppermost rim (56) of the lower half (36) when the shell (22) is in its closed position. The rims (54, 56) engage each other at the forward and rearward edges of the shell and are spaced apart at the side edges (55, 57) thereby forming openings (26, 28). Preferably the openings (26, 28) have lengths (from front to back) of at least 0.5 inches and have heights (from rim (54) to rim (56) at the side edges (55, 57)) of less than 0.10 inches, preferably less than 0.07 inches. The openings (26, 28) are preferably spaced apart from each other by at least 1.25 inches. Preferably the shell (22) has a width of at least 1.25 inches from side (side edge (55)) to side (side edge (57)), and has a depth from front (forward edges (50, 52)) to back (rearward edges (40, 42)) of at least 0.875 inches.

The engagement members (30, 32) may be any soft material which will not harm chains of precious metals. Soft materials include, for example, polymeric foams (for example, polyurethane and polypropylene foams) and leather. The engagement members (30,32) are preferably in the form of pads, and are preferably polymeric foam pads. The member (30) is preferably affixed (attached) to the interior (underside) of upper shell half (34) by an adhesive (any conventional adhesive—glues, epoxies, etc.), and the member (32) is preferably affixed (attached) to the interior (upper side) of the lower shell half (36). The members (30, 32) come into mutual engagement when the shell (22) is in its closed position, and softly engage and embrace chain strands therebetween when chains (60) are placed in the device (20).

When the device (20) is in an open position the engagement member (30) preferably extends from the metallic shell upper half (34) slightly (0.01 to 0.10 inches) beyond the rim (54), and the engagement member (32) preferably extends from the metallic shell lower half (36) slightly (0.01 to 0.1 inches) beyond the rim (56), to ensure that the engagement members embrace the chains (60). When the device (20) is closed, the engagement members (30,32) engage the chains and each other and depress to permit closure of the device (20).

The shell halves (34, 36) may also be referred to as having saucer shapes or having cupped shapes. The openings (24, 26) may also be referred to as mouths.

If the engagement members are not present in the device (if the device is free of the engagement members (foam, leather, etc.)) then the height of the openings (spacing between the rims (54, 56)) is critical to maintain a given sequential order of the chains (60 *a, b, c*) and not permit the chains to roll over each other and become entangled, especially in the case of small chains.

As shown in FIGS. 7, 8, 9, 10 and 12, a multiple strand necklace unit (58) is formed when the device (20) and a plurality of strands (60*a, b, c*) are combined. The unit (58) resists entanglement of the strands (60 *a, b, c*) by maintaining their sequential order, preferably the strands (60*a,b,c*) are spaced sequentially by opposed engagement members (30, 32) embracing (squeezing applying force against) the chain strands (60 *a, b, c*), or alternatively or in combination by the openings being in the form of narrow slits having insufficient heights to permit the chains to change their sequential order. In other words, the openings are sufficiently narrow from rim (54) at side edge (55) to rim (56) at side edge (57) relative to the thickness of the chains (60 *a, b, c* thereby) prohibiting their ability to pass over each other within the slot shaped openings (26, 28). The rim (54) extends downwardly the furthest at the forward edge (50) and steps upwardly at the side edges (55, 57). The rim (56) extends upwardly the furthest at the forward edge (52) and steps downwardly at the side edges (55, 57).

In use, the device (20) is opened and the strands (60 *a, b, c*) are placed onto the lower half (36), and the upper half (34) is pivoted down about the hinge (38). The forward edge (50) of the upper half (34) is pressed against the distal ends of the fingers (46, 48) and further pressed downward into closed position with the fingers (46, 48) holding the forward end of the halves (36,38) into engagement with each other. The engagement members (30, 32) are thereby brought into engagement with each other and embrace the strands (60, *a, b, c*) and restrict their movement within the device. The strands (60 *a, b, c*) pass through the openings (26, 28) at opposite ends of the device (20).

Figure 9:
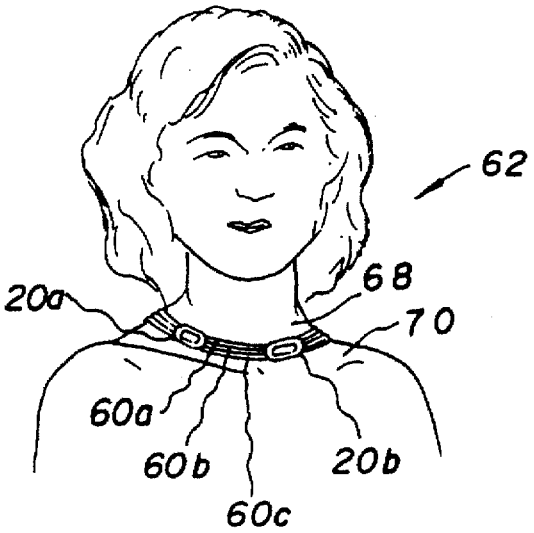
FIG. 9 is a front elevational view of a wearer wearing the unit of FIG. 7 wherin the unit has two device on the front side of the wearer.
Figure 10:
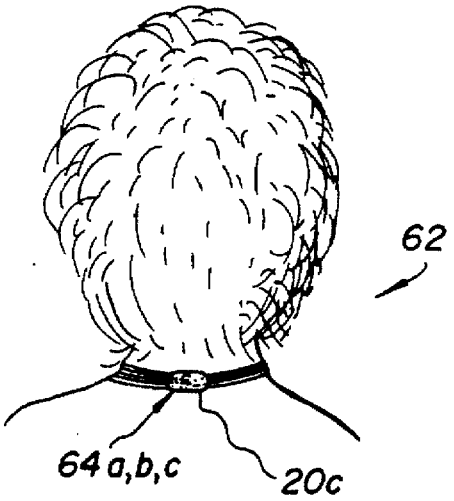
FIG. 10 is a rear elevational view of the wearer of FIG. 9 wherein the unit has one device on the rear side of he wearer.

A wearer (62) may wear the unit and strands (60 *a, b, c*) over the shoulders (70) and about the neck (68) by first placing the chains around the neck (68) and on the shoulders (70), and then placing segments of the strands within one or more devices (20) to produce the unit (58). As shown in FIG. 9, two devices (20) (20*a*, 20*b*) are used to form the unit (58) and maintain the separation of the chains (60 *a, b, c*) and the devices (20) are located on the front side of the wearer (62) in full view of the device (20*c*) or may be located on the back side of the wearer (62) as shown in FIG. 10 in a less conspicious fashion, or the unit (58) may have a plurality of devices (20) (20*a*, 20*b*, 20*c*). Each chain strand has a separate clasp (64 *a, b, c*) for forming a circular chain (60). The device (20) does not function as a clasp, but is rather a separation device.

The strands are preferably fine chains of gold and/or silver having thicknesses of less than 0.10 inches.

The concave shell halves (34, 36) may be smoothly concave or may be transitionally concave by shell half (34) having a top flat (oval) section (100) and downwardly and outwardly extending walls (102) extending therefrom, and by shell half (36) having bottom flat oval section (104) and upwardly and outwardly extending walls (106) extending therefrom.

Figure 11:
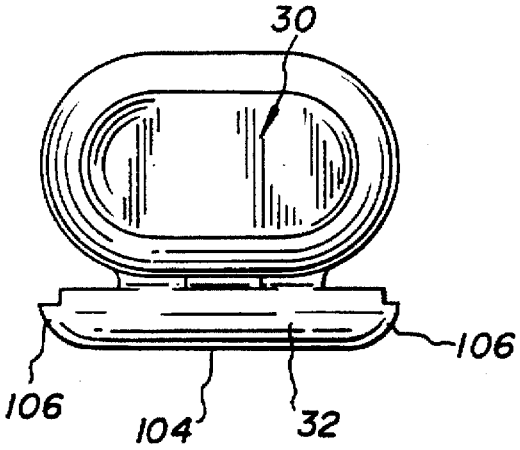
FIG. 11 is a front elevational view of the device FIG. 1 in an open position.
Figure 12:
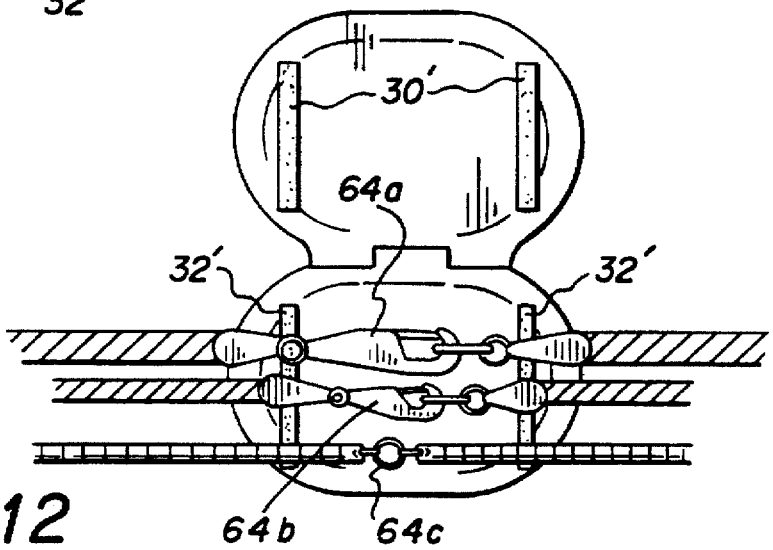
FIG. 12 is a top plan view with the unit of FIG. 7 open showing chain clasps inside of the device of FIG. 1.

FIG. 11 shows the engagement members (30,32) as foam pads having oval shapes, and FIG. 12 shows an alternative shape for the foam engagement members (30', 32') as foam strips adjacent the sides of the halves and extending from adjacent the rear edges to adjacent the forward edges.

What is claimed is:

1. A necklace strand separation device for maintaining the separation of portions of a plurality of necklace strands comprising: (a) a shell having (i) an internal chamber with a rearward edge and a forward edge, (ii) spaced apart openings, (b) a pair of engagement members attached to said shell within said chamber and extended from said rearward edge to adjacent said forward edge for engaging said portions of necklace strands, said members being in mutual engagement when the shell is in its closed position, said members being polymeric foam pads.

2. The device of claim 1 wherein said shell comprises:

(a) an upper concave half, (b) a lower concave half, and (c) a hinge connecting said rearward edge of the upper and lower halves for pivoting relative to each other from open and closed positions.

3. The device of claim 2 wherein said shell comprises a means for biasing said shell in a closed position.

4. The device of claim 3 wherein said means for biasing comprises a pair of spaced apart fingers wherein each finger is adjacent to respective opening.

5. The device of claim 1 wherein said shell is an elongated shell.

* * * * *